US005736009A

United States Patent [19]

Soon-Jai

[11] Patent Number: 5,736,009

[45] Date of Patent: Apr. 7, 1998

[54] GERMICIDAL PACKING PAPER WITH ELECTROCONDUCTIVITY AND METHOD FOR PREPARING THE SAME

[76] Inventor: Kim Soon-Jai, No. 75-19, Nokbon-dong, Eunpyong-gu, Seoul, Rep. of Korea

[21] Appl. No.: 602,604

[22] Filed: Feb. 16, 1996

[51] Int. Cl.[6] ..... D21H 13/50

[52] U.S. Cl. ..... 162/138; 162/146; 162/157.1; 162/180; 162/181.1

[58] Field of Search ..... 162/138, 146, 162/157.1, 180, 181.1

[56] References Cited

U.S. PATENT DOCUMENTS

| | | | |
|---|---|---|---|
| 2,993,816 | 7/1961 | Blake | 162/138 |
| 3,265,557 | 8/1966 | De Fries et al. | 162/138 |
| 3,367,851 | 2/1968 | Filreis et al. | 162/138 |
| 3,539,296 | 11/1970 | Selke | 162/138 |
| 4,645,566 | 2/1987 | Kato et al. | 162/138 |
| 4,711,702 | 12/1987 | Hood | 162/138 |
| 4,728,395 | 3/1988 | Boyd | 162/138 |
| 4,895,620 | 1/1990 | Ko et al. | 162/138 |

FOREIGN PATENT DOCUMENTS

| | | | |
|---|---|---|---|
| 62-268898 | 11/1987 | Japan | 162/138 |
| 63-288298 | 11/1988 | Japan | 162/138 |

*Primary Examiner*—Peter Chin
*Attorney, Agent, or Firm*—Harrison & Egbert

[57] ABSTRACT

A packing paper, superior in antibacterial activity, deodorization and electroconductivity, which is prepared by a method having the steps of making a pulp-dispersed mixture comprising 80 to 94% by weight of an aqueous pulp, 1 to 5% by weight of carbon staple 20 microns or less in diameter, and 5 to 15% by weight of acrylic staple 15 microns or less in diameter and dispersing a rosin and a mineral filler at an amount of 0.5 to 1 g and 15 to 20 g per liter of the pulp-dispersed mixture, respectively. The method further includes the step of forming the resulting mixture into a paper material. The method also includes the step of passing the paper material through several calendars maintained at a temperature of 120° to 150° C.

2 Claims, No Drawings

GERMICIDAL PACKING PAPER WITH ELECTROCONDUCTIVITY AND METHOD FOR PREPARING THE SAME

BACKGROUND OF THE INVENTION

1. Field of the Invention

The present invention relates to packing paper preventive of static electricity. More particularly, the present invention relates to packing paper comprising copper-coordinated acrylic fiber, which shows both germicidity and electroconductivity. Also, the present invention is concerned with a method for preparing the same.

2. Description of the Prior Art

Recently, electronic parts and electromagnetic equipment have been comprised of highly integrated circuits. Since highly integrated circuits are sensitive even to weak static electricity, the electronic or electromagnetic articles, which are generally expensive, are likely to become nonfunctional or dysfunctional under the influence of static electricity. Besides, explosive materials, such as gunpowder, or low ignition point materials are also susceptible to static electricity and can explode when coming in contact with static electricity.

In order to eliminate the influence of static electricity, such electrical articles, explosives or low ignition point materials each have been packed with silver paper; however, it does not permit the emission of the moisture generated from its interior. In addition, such silver paper is expensive. Thus, the economics of the use of silver paper are unfavorable.

Besides, a corrugated cardboard which has the inner surface coated with a paint layer containing electroconductive carbon powder was developed as a means of protecting such articles from static electricity. However, the corrugated cardboard, as a packing means, cannot guard the articles. In addition, it cannot induce the static electricity generated in the articles into the coating layer. Further, the paint layer coated on the inner surface of the corrugated cardboard has significant disadvantages including an increase of the production cost and contagious contamination.

Another electroconductive packing paper with the aim of prevention of static electricity is disclosed in Korean Pat. Publication No. 2608. This electroconductive packing paper seems to be superior in electroconductivity but is insufficient in hydration upon paper-extraction working. It lacks compatibility with pulp, resulting in bad workability. When used in a large quantity, the electroconductive packing paper has an uneven surface due to its low thermoplasticity. Further, as it stands, it becomes stiff.

In spite of their own disadvantages, the above-illustrated packing paper plays a role of preventing the damage of static electricity to the electronic parts, electromagnetic equipments, explosive materials or low ignition point materials.

Recently, as the amount of export and import goods increases, various environmentally harmful effects attributed to the packing paper or its contents, including diseases, virus and pollutants, are diffused all over the world. Thus, the restrictions to the packing paper become more seriously strict.

SUMMARY OF THE INVENTION

It is an object of the present invention to overcome the above problems encountered in the prior art and to provide packing paper which is germicidal as well as electroconductive.

It is another object of the present invention to provide germicidal packing paper with electroconductivity, which has improved tensile strength and tear strength.

It is another object of the present invention to provide a method for preparing the packing paper.

Intensive research repeated by the present inventors aiming to develop germicidal packing paper with electroconductivity having such preferred physical properties has resulted in finding that thermoplastic acrylic fibers can be fused with carbon fibers and pulps by calendaring them.

It has been found from such a point of view as described above that the objects previously described can be achieved by providing germicidal packing paper with electroconductivity which is prepared by a method for preparing electroconductive and germicidal packing paper, comprising the step of making a pulp-dispersed mixture comprising 80 to 94% by weight of an aqueous pulp, 1 to 5% by weight of carbon staple 20 microns or less in diameter, and 5 to 15% by weight of acrylic staple 15 microns or less in diameter. The method further includes the step of and dispersing a rosin and a mineral filler at an amount of 0.5 to 1 g and 15 to 20 g per liter, respectively, of the aqueous pulp mixture. This method further includes the step of forming the resulting mixture into a paper material. The paper material is passed through several calendars maintained at a temperature of 120° to 150° C.

DETAILED DESCRIPTION OF THE INVENTION

In accordance with the present invention, the germicidal packing paper with electroconductivity is prepared from a mixture comprising about 80 to 94% by weight of an aqueous pulp, about 1 to 5% by weight of carbon fiber 6 mm or less in length with a diameter of 20 microns or less, and about 5 to 15% by weight of acrylic fiber 6 mm or less in length with a diameter of 15 microns or less.

The carbon fiber used in the present invention is a carbide obtained by subjecting an acrylonitrile fiber to thermal treatment at about 3,000° C. and is light and superior in electrical conductivity and tensile strength with a specific resistivity of $0.7–1.0\times10^{-3}$/cm.

An acrylic fiber plays an important role in electroconductive and antibacterial activity in the present invention and can be prepared by thermally treating a tow or soup of acrylic in a bath containing cupric salts and a reducing agent, to make cuprous ions absorb to the acrylic and treating it in a liquid or gas phase capable of emitting at least one sulfur component selected from the group consisting of sulfur atoms and sulfur ions, to convert the absorbed cuprous ions into stable cuprous sulfides, or by treatment of acrylic in a bath containing cupric ions, a reducing agent therefor, and at least one sulfur component selected from the group consisting of sulfur atoms and sulfur ions.

After being stirred sufficiently, the mixture is added with a sizing agent and a mineral filler, according to the present invention. For amount, the sizing agent and the mineral filler are on the order of 0.5 to 1 g and 15 to 20 g per liter of the mixture, respectively. These concentrations are only two thirds of those added in conventional paper formation process. Excess amounts of the sizing agent or filler may cause a decrease of the electroconductivity of the resulting packing paper.

In conventional paper-making processes, drying is carried out at about 80° C. In contrast with conventional paper-making processes, the method according to the present invention has a drying temperature of about 120° to 140° C.

The calendaring of the mixture under such high temperatures makes the thermoplastic acrylic fiber melt and thus stick to the pulp and carbon fiber so that the reciprocal adhesiveness therebetween is improved, thereby significantly increasing the physical properties including tensile strength, tear strength and smoothness.

In more detail, the electroconductive and germicidal acrylic fiber is obtained by thermally treating the acrylic in a bath or atmosphere containing a cuprous sulfite salt resulting from the reduction of cupric compounds or ions into cuprous ions and a stabilizing agent for the salt, at one process subsequent to removal of solvent in continuous manufacture of acrylic fiber. The acrylic fiber used in the present invention consists mainly of acrylonitrile and becomes electroconductive by coordinate bond with copper, cyan and sulfur, thereby preventing the occurrence of static electricity. The electroconductivity retained by the acrylic fiber is stable to mechanical abrasion and chemical action. In addition, although a small amount of the acrylic fiber is mixed with other fibers, the resulting article has a good effect of preventing static electricity. In this electroconductive acrylic fiber, copper is typically contained at an amount of about 1 to 2% by weight. Such amount of copper is sufficient to show antibacterial activity and deodorization. The electroconductive acrylic fiber has a structure as follows:

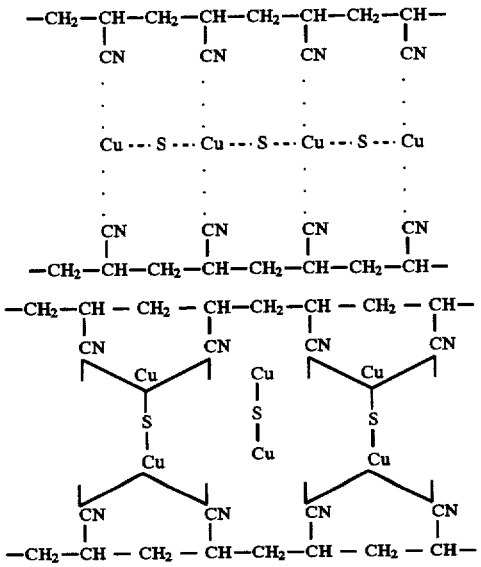

[I]

[II]

Superior as carbon fiber in electroconductivity, it is deficient in hydration upon carrying out the extraction of paper. Since it is very difficult to fibrillate carbon fiber, it lacks the adhesion to pulp, which causes difficulty in making the extract of paper. Due to strong stiffness, carbon fiber may provide unfavorable effects to the resulting paper when being used in large amounts. In accordance with the present invention, carbon fiber is used at an amount of 1 to 5% by weight.

The acrylic fiber is smoother and has better adhesion to pulp than carbon fiber. But, the paper-extraction working also becomes difficult when the acrylic fiber is used much. In addition, a large amount of the acrylic fiber incapacitates the resulting paper's ability to maintain a shape. In accordance with the present invention, the acrylic fiber is used at an amount of about 5 to 15% by weight. It has a specific resistivity of $2.3\times10^{-1}$ to $7.6\times10^{-2}$ $cm^{-1}$ with a copper content of 1.0 to 2.0%.

Less than 1% of carbon fiber or 5% of the acrylic fiber results in very weak increases in electroconductivity and germicidity.

With germicidity and electroconductivity, the packing paper according to the present invention, as described above, is prepared from germicidal and electroconductive acrylic fiber, electroconductive carbon fiber and pulp. As illustrated below, the packing paper according to the present shows a remarkable increase in tensile strength and tear strength of the order of two- or threefold relative to conventional packing paper prepared only from pulp.

A better understanding of the present invention may be obtained in light of following examples which are set forth to illustrate, but are not to be construed to limit, the present invention.

EXAMPLE 900 kg of pulp was suspended in water. Thereafter, 30 kg of carbon fiber 6 mm or less in length with a diameter of 20 microns or less and 70 kg of acrylic fiber 6 mm or less in length with a diameter of 15 microns or less were added in the suspension and stirred enough to give a mixture. Rosin soap and mineral material were added in an amount of 1 g and 18 g per liter of the mixture, respectively, and sufficiently dispersed or dissolved therein. At that moment, the concentration of the paper material was 5.6%.

Such mixture was paper extracted with a circular network type machine and then dried. Subsequently, the dried extract passed through several calendars maintained at a temperature of 120° to 140° C., to prepare germicidal and electroconductive packing paper with a size of 0.06, 0.07, 0.08, 0.09 and 0.1 mm. In comparison, packing paper with the same sizes was prepared with the pulp in a conventional process.

The packing paper had a specific resistivity of $4.2\times10^{-2}$ $cm^{-1}$ and showed about 1.8 times and 2.6 times as high as the tear strength and the tensile strength of the conventional packing paper, respectively.

The present invention has been described in an illustrative manner, and it is to be understood the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

What is claimed is:

1. A method for preparing electroconductive and germicidal packing paper comprising the steps of:

making a pulp-dispersed mixture comprising 80 to 94% by weight of pulp solids in an aqueous pulp suspension, 1 to 5% by weight of carbon staple 20 microns or less in diameter, and 5 to 15% by weight of acrylic staple 15 microns or less in diameter;

adding and dispersing a rosin and a mineral filler at an amount of 0.5 to 1 g and 15 to 20 g per liter, respectively, of said pulp-dispersed mixture;

forming a paper material from the resulting mixture; and passing the formed paper material through several calendars maintained at a temperature of 120° to 150° C.

2. The method in accordance with claim 1, wherein said acrylic staple contains copper at an amount of 1 to 2% by weight.

* * * * *